United States Patent [19]

Fujimoto

[11] 4,231,137

[45] Nov. 4, 1980

[54] CLASP FOR PERSONAL ORNAMENTS OR FURNISHINGS

[76] Inventor: Toshio Fujimoto, 7-6, Ochayasho-cho, Nishinomiya-shi, Hyogo-ken, Japan

[21] Appl. No.: 5,831

[22] Filed: Jan. 23, 1979

[30] Foreign Application Priority Data

Jun. 29, 1978 [JP] Japan ..... 53-90276[U]

[51] Int. Cl.[3] ..... A44B 17/00

[52] U.S. Cl. ..... 24/201 B

[58] Field of Search ..... 24/201 B, 73 MS

[56] References Cited

U.S. PATENT DOCUMENTS

| | | | |
|---|---|---|---|
| 2,637,887 | 5/1953 | Goodman et al. | 24/201 B UX |
| 2,648,884 | 8/1953 | Loofboro | 24/201 B |
| 3,063,118 | 11/1962 | Salter et al. | 24/201 B |
| 3,111,736 | 11/1963 | Budreck | 24/201 B |
| 3,129,477 | 4/1964 | Mizuno | 24/201 B |
| 3,324,521 | 6/1967 | Humiston | 24/201 B |
| 3,341,906 | 9/1967 | Williams | 24/201 B X |
| 3,621,690 | 11/1971 | Whitcomb | 24/201 B X |

*Primary Examiner*—Philip C. Kannan

*Attorney, Agent, or Firm*—Browdy and Neimark

[57] ABSTRACT

A clasp is designed to be attached to an annular personal ornament or furnishing, such as a necklace or bracelet, to form a portion of the same. The clasp comprises two metallic parts of substantially the same shape adapted to be coupled together by the combined action of magnetic attraction and mechanical engagement, enabling the person to put on and off the ornament or furnishing with great ease. The clasp will resist tension, which is the most frequent force acting thereon during use, by the coupling force provided by the mechanical engagement, so that it will never decouple of itself.

7 Claims, 5 Drawing Figures

CLASP FOR PERSONAL ORNAMENTS OR FURNISHINGS

FIELD OF THE INVENTION

The present invention relates to a clasp for personal ornaments or furnishings, such as necklaces, bracelets, wrist watch bands, and waist belts. More particularly, it relates to a clasp comprising two metallic parts adapted to be coupled together by the combined action of magnetic attraction and mechanical engagement.

BACKGROUND OF THE INVENTION

There have heretofore been proposed various constructions for clasps for personal ornaments or furnishings. For example, bolt-ring and swivel types are known and they resort to mechanical means for coupling. These types, therefore, are relatively high in coupling force, but, on the other hand, since they are complicated in construction, the coupling and decoupling operation is troublesome, sometimes making it impossible for the user to put on and take off the ornament or furnishing without calling for a helping hand. Another type which utilizes magnetic attraction for coupling purposes has also been proposed. Although this type is easy to couple and decouple, it is so low in coupling force that there is a danger of the ornament or furnishing falling off the wearer of itself during use.

SUMMARY OF THE INVENTION

A first object of the present invention is to provide a clasp which is easy to couple and decouple and high in coupling force.

A second object of the present invention is to provide a clasp designed to effect coupling by the combined action of magnetic attraction and mechanical engagement.

A third object of the present invention is to provide a clasp designed so that the direction of coupling force provided by the combined action of magnetic attraction and mechanical engagement is perpendicular to the direction in which the load normally acts on the clasp, i.e., the direction of tension, so that the working load or tension is not effective to decouple the clasp.

A further object of the present invention is to provide a clasp comprising two metallic parts adapted to be rotatable relative to each other, so that if it is used by being attached to a necklace or bracelet, it will be bent at the junction between the metallic parts to extend closely along the curved surface of the wearer's neck or wrist or arm.

Another object of the present invention is to provide a clasp which, in its coupled state, is roundish as a whole and easily rollable and whose size is such that the dimension perpendicular to the junction surface is longer than the dimension parallel to the junction surface so that in use it will roll of itself to assume a stabilized orientation which allows the junction surface to extend along the curved surface of the wearer's body, preventing the clasp from being decoupled during use.

DESCRIPTION OF THE PREFERRED EMBODIMENT

Figure 1:
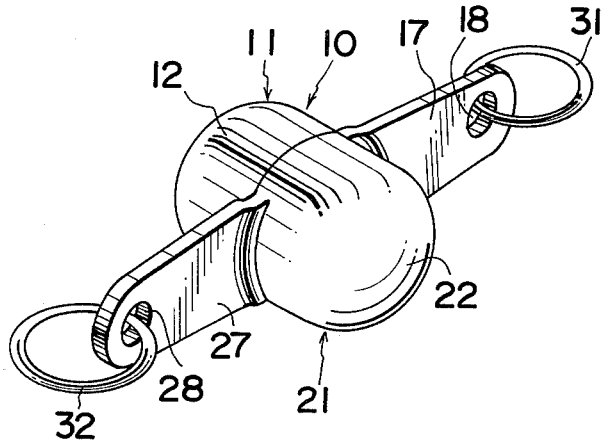
FIG. 1 is a perspective view of an embodiment of the present invention in its coupled state.
Figure 2:
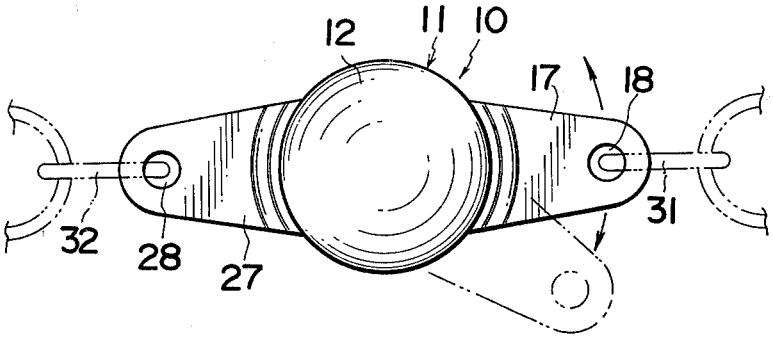
FIG. 2 is a plan view of the FIG. 1 embodiment in its coupled state.
Figure 3:
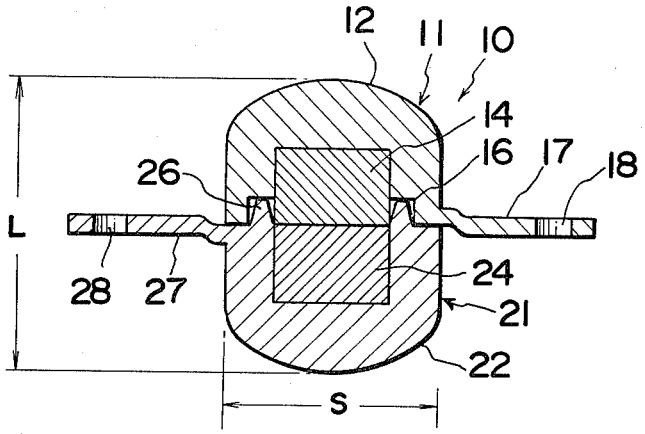
FIG. 3 is a sectional view of the FIG. 1 embodiment in its coupled state.
Figure 4:
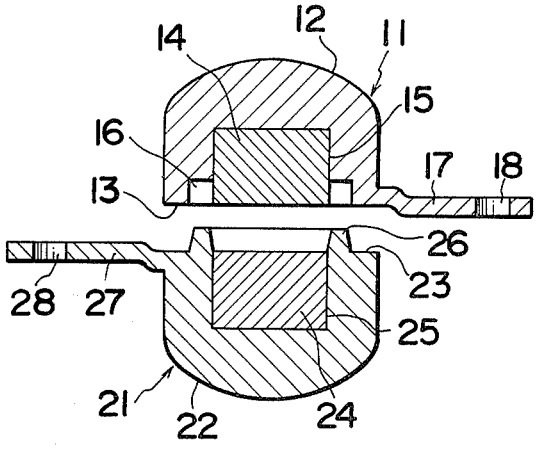
FIG. 4 is a sectional view of the FIG. 1 embodiment in its decoupled state.
Figure 5:
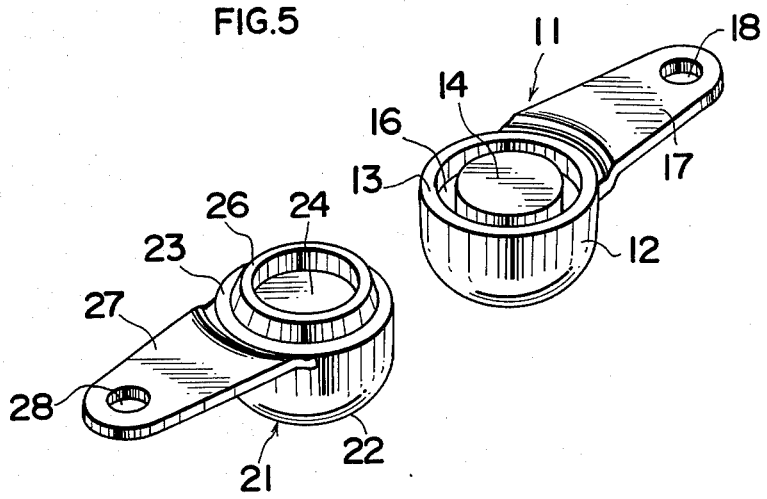
FIG. 5 is a perspective view showing the decoupled state of the metallic parts of the FIG. 1 embodiment.

A clasp embodying the present invention will now be described with reference to the drawings.

A clasp 10 comprises metallic parts 11 and 21. The metallic parts 11 and 21 have outer surfaces 12 and 22, respectively, which are the same in shape, each being substantially hemispherical. However, the hemispheres are greater in height than the corresponding true hemispheres so that when the metallic parts 11 and 21 are coupled together, the longitudinal dimension L, i.e., the dimension perpendicular to the junction surface, is longer than the transverse dimension S, i.e., the dimension parallel to the junction surface. It is preferable that the ratio of the longitudinal dimension L to the transverse dimension S be greater than at least 1.2. The metallic parts 11 and 21 are made of noble metal or of brass or plastics plated with metal. Further, the outer surfaces 12 and 22 may be engraved with designs, if desired. The metallic parts 11 and 21 are adapted to be coupled together so that their respective surfaces 13 and 23 are opposed to each other. Magnets 14 and 24 are embedded in the coupling surfaces 13 and 23 of the metallic parts 11 and 21, respectively. As for the magnets 14 and 24, use is made of a magnet with a high power of magnetic attraction, such as a ferrite magnet or rare earth element-cobalt magnet. The magnets 14 and 24 are fitted in recesses 15 and 25 formed in the coupling surfaces 13 and 23 of the metallic parts 11 and 21, respectively, and are firmly fixed therein as by press fit, crimping or adhesive agent so that they will not come out. In addition, in embedding the magnets 14 and 24 in the metallic parts 11 and 21, they are oriented in opposed polarity relation so that when the coupling surfaces 13 and 23 of the metallic parts 11 and 21 are brought close to each other, the magnets 14 and 24 attract each other. The coupling surface 13 of one metallic part 11 is formed with an annular groove 16 while the coupling surface 23 of the other metallic part 21 is formed with a mating annular projection 26, so that when the metallic parts 11 and 21 are coupled together, the projection 26 is fitted in the groove 16. In addition, the projection 26 is tapered to facilitate insertion into the groove 16. The metallic parts 11 and 21 are provided with flanges 17 and 27, respectively, which are in the same plane as the coupling surfaces 13 and 23 of the metallic parts 11 and 21 and extend laterally therefrom. The flanges 17 and 27 are formed at their front ends with holes 18 and 28 for connection to rings 31 and 32 at the ends of a personal ornament. The flanges 17 and 27 are sufficiently large to serve as knobs in handling the metallic parts 11 and 21 for coupling and decoupling operation.

How to use the clasp of the present invention is described below.

First of all, the metallic parts 11 and 21 are attached to the ends of an annular personal ornament, such as a necklace or bracelet. This attachment is effected by connecting the rings 31 and 32 at the ends of the personal ornament to the holes 18 and 28 in the flanges 17 and 27 of the metallic parts 11 and 21. The personal ornament with the metallic parts 11 and 21 thus attached to the ends thereof is wrapped or placed around the neck or arm in the same manner as in an ordinary personal ornament and the metallic parts 11 and 21 are then coupled together to form an annular assembly. The operation for coupling the metallic parts only needs to nip the flanges 17 and 27 of the metallic parts 11 and 21 with the fingers and bring the metallic parts 11 and 21 close to each other. The metallic parts 11 and 21 thus brought close to each other will attract each other owing to the magnetic attraction of the magnets 14 and 24, with the result that the projection 26 on the metallic part 21 automatically engages the groove 16 in the metallic part 11, so that the coupling operation can be completed instantaneously. In bringing the metallic parts 11 and 21 close to each other, there is no need of considering which direction the metallic parts 11 and 21 face. If the direction is correct, the magnets 14 and 24 of the metallic parts 11 and 21 will attract each other whereas if it is not correct, they will repel each other. Therefore, only bringing the metallic parts 11 and 21 close to each other will result in the metallic parts being correctly oriented so that the coupling surfaces 13 and 23 face each other to be coupled together. The operation for coupling the metallic parts 11 and 21 is very simple, as described above. Thus, if the clasp is used with a necklace, coupling can be effected without calling for a helping hand by simply bringing the metallic parts backward around the neck and toward each other. Further, if it is used with a bracelet, coupling can be effected by simply placing one of the metallic parts on the arm and holding it in position and bringing the other metallic part close thereto by one hand. When the metallic parts 11 and 12 are thus coupled together, this coupled state is maintained by the combined action of the magnetic attraction between the magnets 14 and 24 and the engagement between the projection 26 and the groove 16. Generally, the usual, most frequent force acting on the clasps of personal ornaments or furnishings is tension. In the case of the clasp of the present invention, such tension acts on the junction between the projection 26 and the groove 16 and is resisted by the mechanical coupling force at the junction, so that said coupling will never be destroyed no matter how high a tension acts on the clasp. Further, with the metallic parts 11 and 21 in the coupled state, the longitudinal dimension L is greater than the transverse dimension S and the assembly of the metallic parts 11 and 21 is roundish as a whole, so that when the coupled metallic parts come into contact with the user's body, they will automatically roll thereon until they assume a transverse position, i.e., a position in which the coupled direction of the metallic parts extends along the user's body. As a result, the tension on the clasp cannot act as a force effective to pull apart the metallic parts 11 and 21. In this connection, if the clasp assumed a longitudinal position, i.e., a position in which the coupled direction is perpendicular to the user's body, the tension on the clasp would act as a force effective to pull apart the metallic parts on the lever principle if the body surface has a sharp curve. As described above, since the metallic parts 11 and 21 will automatically roll to assume the transverse position, what is more advantageous is that the metallic parts rotate of themselves relative to each other until the flanges extend along the curve of the body, so that the clasp snugly fits on the curve of the body. When it is desired to decouple the metallic parts coupled in the manner described above, this can be easily accomplished by nipping the flanges 17 and 27 of the metallic parts with the fingers and pulling them while twisting.

While only an embodiment of the invention illustrated in the drawings has been described, the invention is not limited thereto and various changes may be made within the scope of the claims.

What is claimed is:

1. A clasp for personal ornaments or furnishings, the clasp comprising two metallic parts at least one of which attracts the other by virtue of magnetic property, said metallic parts can be removeably coupled together, one of the said metallic parts having an annular projection formed on the coupling surface thereof, the other of said metallic parts having an annular groove formed in the coupling surface thereof, so that when the said two metallic parts are coupled together, said annular projection is fitted in said annular groove, said one of said parts and said other of said parts being free to rotate with respect to one another when coupled together, each of said metallic parts being formed with a respective flange which extends laterally in the same plane as that of the respective said coupling surfaces of said metallic parts, said two metallic parts being of substantially identical external shape, each said metallic part having an approximately cylindrical portion adjacent its said coupling surface and an approximately semispherical end opposite its said coupling surface such that when said two metallic parts are coupled together, the length of the clasp from end-to-end is longer than the diameter of said approximately cylindrical portions, whereby the coupling direction can be extended along a surface of a wearer's body with the cylindrical portions resting against the user.

2. A clasp for personal ornaments or furnishings as set forth in claim 1, wherein when said two metallic parts are coupled together, said dimension perpendicular to junction surface is at least 1.2 times the dimension extending along the junction surface.

3. A clasp for personal ornaments or furnishings as set forth in claim 1 or claim 2, wherein said projection is tapered.

4. A clasp for personal ornaments or furnishings as set forth in claim 1 or claim 2, wherein said annular projection is tapered toward its front end to facilitate fitting into said groove.

5. A clasp for personal ornaments or furnishings as set forth in claim 1 or claim 2, wherein each of said metallic parts includes a power magnet positioned therein.

6. A clasp for personal ornaments or furnishings as set forth in claim 5, wherein one of said magnets is positioned in that one of said metallic parts which is provided with said annular groove and defines an inner annular wall of said groove.

7. A clasp for personal ornaments or furnishings as set forth in claim 6, wherein the other of said magnets is positioned in that one of said metallic parts which is provided with said annular projection and defines its height.

* * * * *